United States Patent [19]

Freitag

[11] Patent Number: 5,018,986

[45] Date of Patent: May 28, 1991

[54] ELECTRICAL CONNECTOR

[76] Inventor: Wolfgang Freitag, Arndtstrasse 9-11, 2351 Trappenkamp, Fed. Rep. of Germany

[21] Appl. No.: 590,657

[22] Filed: Sep. 28, 1990

[30] Foreign Application Priority Data

Sep. 28, 1989 [DE] Fed. Rep. of Germany ..... 3932346

[51] Int. Cl.[5] ..... H01R 4/24

[52] U.S. Cl. ..... 439/421

[58] Field of Search ..... 439/389, 395-397, 439/399, 400, 406, 407, 409, 410, 417, 418, 421-424, 442, 443, 444

[56] References Cited

U.S. PATENT DOCUMENTS

| | | | |
|---|---|---|---|
| 3,831,132 | 8/1974 | Bowden, Jr. et al. | 439/442 |
| 4,114,975 | 9/1978 | Weidler | 439/395 |
| 4,264,118 | 4/1981 | Nijman | 439/407 |

*Primary Examiner*—Joseph H. McGlynn
*Assistant Examiner*—Hien D. Vu
*Attorney, Agent, or Firm*—Dvorak and Traub

[57] ABSTRACT

A connector for use with insulated cables comprises an insulating holder for the insertion thereinto of at least one elongate contact pin having a rear portion provided with at least one bendable, wing-like clamping part, projecting at right angles from the rear portion when in a non-clamping position. The clamping part can be bent over against the cable to penetrate its insulation thereby to make electrical contact with a conductor of the cable. For more rapid connection, and to ensure better electrical contact between cable and conductor and contact pin, the clamping part is formed as an apertured clamping lug, the rear portion of the contact pin having at least one projection which is at least partially surrounded by the lug in the clamped position thereof. The lug has at least one cutting edge on its inner perimeter and/or the projection has at least one such edge on its upper perimeter. The lug can be bent into an intermediate position after the contact pin has been inserted into the holder, in which position the lug locks the contact pin in the holder.

18 Claims, 7 Drawing Sheets

FIG. 4
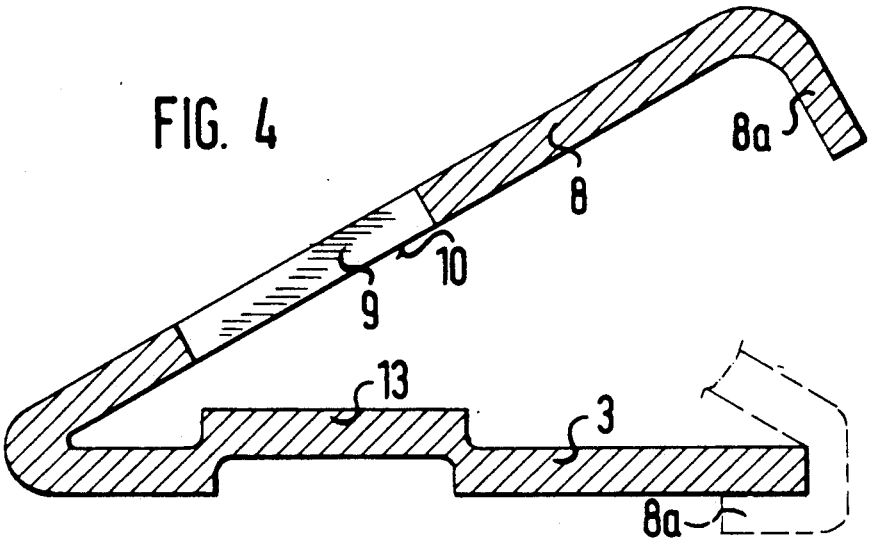
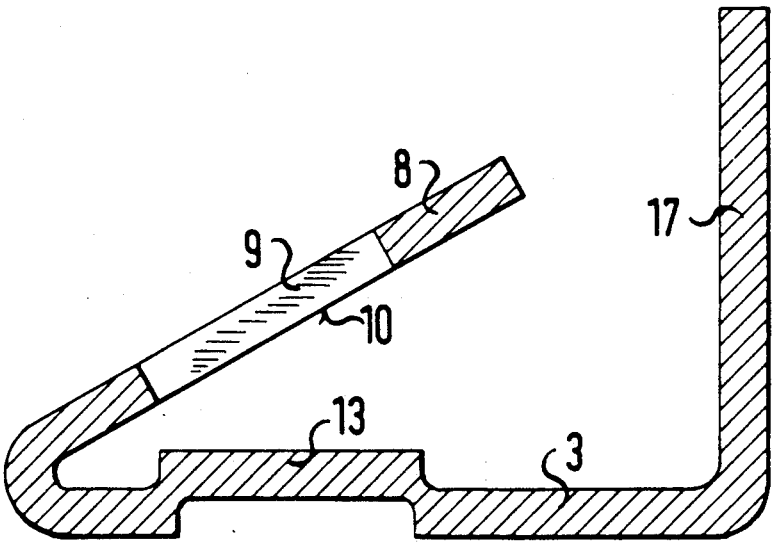
FIG. 5
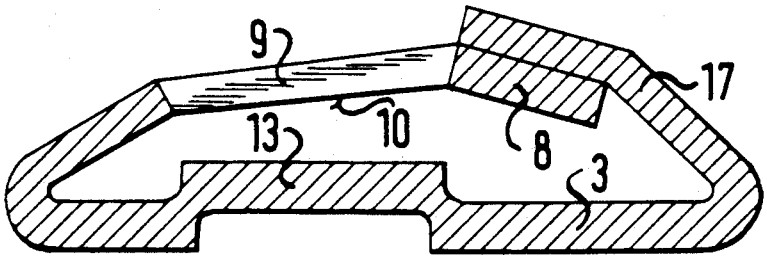
FIG. 6

ELECTRICAL CONNECTOR

FIELD OF THE INVENTION

The invention relates to an electrical connector, in particular for multiple core cables, comprising an insulating holder for the insertion thereinto of at least one elongate contact pin having a rear portion provided with at least one bendable, wing-like clamping part, projecting at right angles from said rear portion before the insertion of the contact pin into the holder. The clamping part can be bent over so as to penetrate the cable insulation thereby to make electrical connection with a desired conductor of the cable.

BACKGROUND OF THE INVENTION

In the use of such a connector, the contact pin is removed from the insulating holder before the contact pin is clamped to the cable. A solderless electrical connection is then made to the corresponding conductor of the cable, after which the contact pin is reinserted in the holder. The contact pin has a springy blade which snaps back after the pin has been pushed into the holder, thereby fixing the pin in the holder. The removal and reinsertion of the contact pin are both time-consuming and laborious. Also the pin may not be reinserted into the holder with sufficient care to cause it to be correctly seated therein, thereby impairing or preventing subsequent electrical contact between the pin and a mating contact element. The said rear portion is provided with short clamping parts having serrated, or similarly profiled, free ends. Mainly, it is such serrations or the like which penetrate the insulation of the cable and make contact with the cable conductor. In order to obtain effective electrical contact between the contact pin and the conductor, the clamping parts must be bent over and crimped to the cable with great care. If the cable conductor consists of a multiplicity of thin filaments, the serrations or the like make insufficient contact therewith to provide effective electrical contact between the contact pin and the conductor and/or permanent electrical contact therebetween is not assured.

SUMMARY OF THE INVENTION

The invention is intended to provide an electrical connector of the type referred to above but with which effective and lasting electrical contact can be made between the contact pin of the connector and the cable conductor, such contact being rapidly and simply effected without removing the contact pin from the holder.

According to the invention, the wing-like clamping part is formed as an apertured clamping lug, the rear portion of the contact pin has at least one projection which is at least partially surrounded by the lug in the clamped condition thereof, the lug has at least one cutting edge on its inner perimeter and/or the projection has at least one such edge on its upper perimeter, and the lug can be bent into an intermediate position after the contact pin has been inserted into the holder, in which position the lug locks the contact pin in the holder.

A secure and durable electrical contact between the rear portion of the contact pin and the cable conductor to be connected is thereby obtained, as the cutting edges of the projection and/or of the clamping part mating therewith penetrate the cable insulation and establish electrical contact with the cable conductor over an extended line of contact. The contact pin need not be removed from the holder in order to clamp the contact pin to the cable conductor. Also the contact pin is retained in the holder without the need for the holder and/or contact pin to be specially designed to this end. At the same time, the contact pin when inserted into the holder is ready for clamping a cable conductor without any further modification of the contact pin. The configuration of the rear portion of the contact pin enables it to be clamped to the cable conductor by means of a simple tool, to make firm electrical contact with the cable conductor.

BRIEF DESCRIPTION OF THE DRAWINGS

FIG. 4 is a cross-sectional view of a second, slightly modified, embodiment, of the invention;

FIGS. 5 and 6 are cross-sectional views of a third, and again slightly modified, embodiment of the invention;

DETAILED DESCRIPTION OF THE INVENTION

The electrical plug connector comprises a known casing, which will not be described here, retaining an insulating holder 6, shown in FIGS. 1, 9, 10 and 11, in which, in turn, a contact pin, or a number of contact pins, described below is, or are, fitted.

Figure 1:
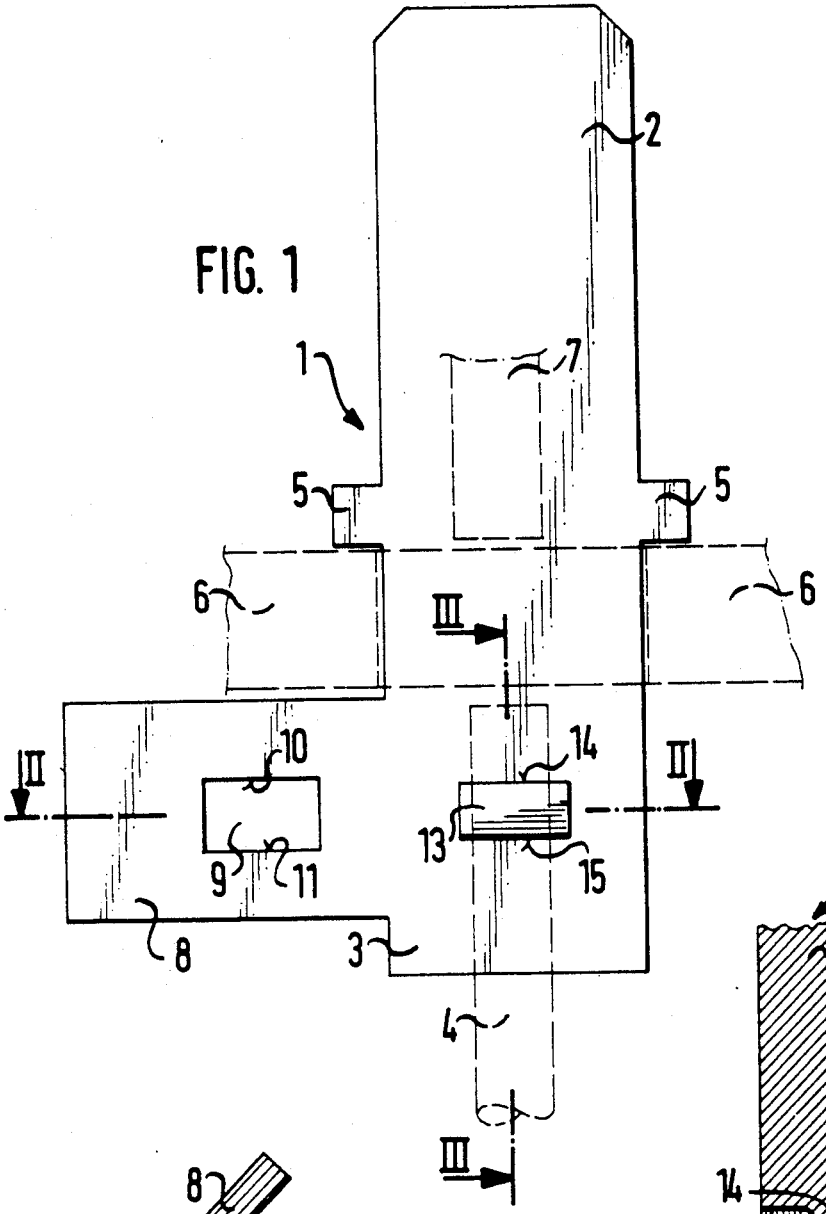
FIG. 1 is a plan view of an electrical plug connector according to a first embodiment of the invention, in a part finished condition.

As shown in FIG. 1, according to the first embodiment, a part stamped out of sheet material of predetermined thickness as a partially finished contact pin 1 has a forward portion 2 for plugging into a mating connector and a rear clamping portion 3 to which is connected a cable 4, or a conductor of a multiple core cable. One or two (as shown) lateral projections 5 serve as forward stops for engaging against the insulating holder 6, which is shown in broken lines. A spring tongue 7, stamped from the portion 2 and bent slightly out of its plane may also be used for engaging the holder 6.

Figure 3:
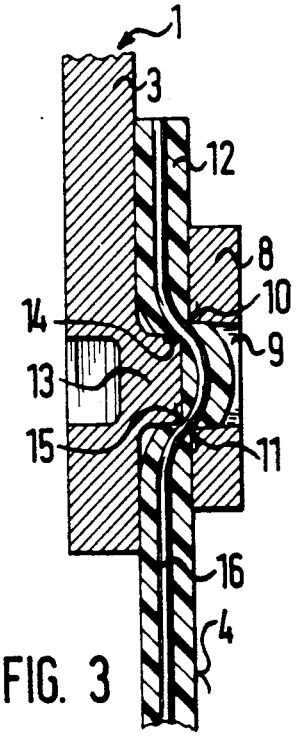
FIG. 3 is a partial longitudinal section taken on the lines III—III in FIG. 1, showing the connector in its clamped condition.

The rear portion 3 of the contact pin 1 which portion is to be connected to the cable 4, has a laterally projecting, rectangular, elongate, clamping part in the form of a lug 8 having a punched-out window 9 therein. On the clamping side of the window 9 are two essentially parallel, opposite, internal cutting edges 10 and 11, which penetrate the insulation 12 of the cable 4, as shown in FIG. 3, when the portion 3 has been clamped thereto. The cutting edges 10,11 are arranged essentially at right angles to the longitudinal direction of the contact pin 1, so that the insulation 12 of the cable 4 is severed in a crosswise, or in an essentially crosswise, direction.

Figure 2:
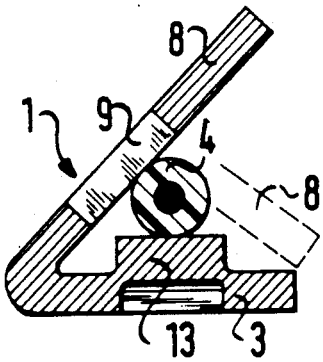
FIG. 2 is a view taken on the lines II—II in FIG. 1, showing the connector ready for clamping.

A clamp projection 13 of the portion 3 is located relative to the window 9, so that when the lug 8 is ready for assembly to the cable 4 as shown in FIG. 2, or is in its clamped position as shown in FIG. 3, the window 9 at least partially surrounds the projection 13. The top of the projection 13 is formed with two transverse cutting edges 14 and 15, which, like the cutting edges 10 and 11 of the lug 8 cut through the insulation 12 of the cable 4 crosswise, in order to make electrical connection between the cable conductor 16 and the contact pin 1.

As will be apparent from FIGS. 2 and 3 the projection 13 is produced by stamping out a zone of the portion 3 corresponding to the projection 13, by means of suitable stamping tools to cause it to project from the portion 3. Alternatively, a component corresponding to the projection 13 could be attached to the upper face of the portion 3.

FIG. 2 shows the contact pin 1 ready for clamping to the cable 4 with the lug 8 in an angled position with respect to the remainder of the portion 3, so that the cable 4 or, if the cable has individual insulated conductors, the desired conductor of that cable, can be securely positioned on the projection 13. It then only remains for the lug 8 to be pressed against the portion 3, as indicated in broken lines in FIG. 2 for the cable 4, or said corresponding conductor to be electrically connected to the contact pin 1.

FIG. 3 shows the lug 8 in its final position, in which all of the cutting edges 10, 11 and 14, 15 have severed the insulation 12 of the cable 4 and are thus in contact with the conductor 16. The cable 4 is, therefore, mechanically and electrically connected to the contact pin 1.

The embodiment of FIG. 4 is modified with respect to that of FIGS. 1, 2 and 3 only in so far as the lug 8 is provided with an extension 8*a* at its free end, for clasping about the portion 3, as shown in broken lines, when the lug 8 is in its clamped condition. This ensures that the clamped condition of the lug 8, and thus excellent electrical contact between cable and contact pin, are sustained under all circumstances. T As shown in FIGS. 5 and 6, instead of the extension 8*a*, a corresponding additional clamping flange 17 is provided on the portion 3, opposite to the lug 8. In the clamped condition of the contact pin the flange 17 is clasped about the free end of the lug 8 as shown in FIG. 6 to keep it pressed firmly down,.

The cross-sections shown in FIGS. 4 to 6 correspond to the cross-section in FIG. 2. In other respects the contact pins 1 in FIGS. 4 to 6 are constructed as shown in FIGS. 1 to 3.

Figure 7:
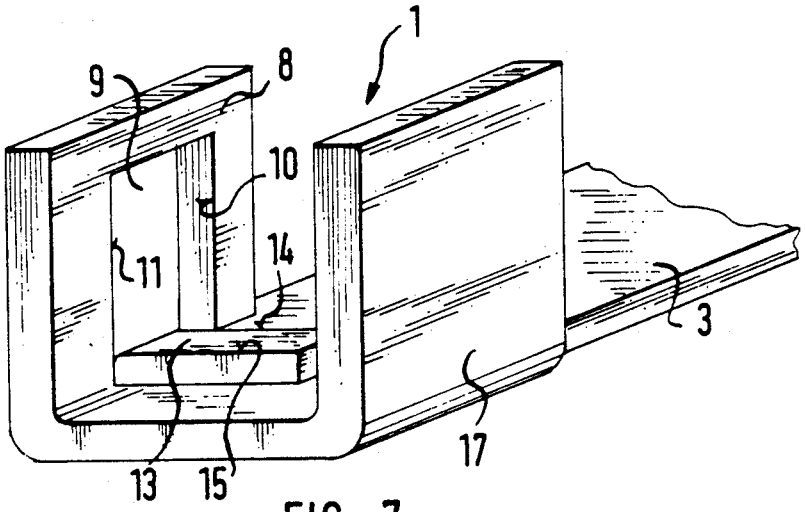
FIG. 7 is a fragmentary isometric view of a further embodiment of the invention.

The embodiment shown in FIG. 7 is essentially similar to that shown in FIGS. 5 and 6, excepting that the clamping projection 13 is produced by stamping the blank for forming the lug 8 in the area for forming the window 9 and by bending over the tab so provided so that the tab lies on the central part of the portion 3 thus constituting the projection 13. The tab is generally rectangular in shape and is integrally formed with the portion 3 at its edge adjacent thereto. The punching-out of the tab simultaneously produces the lug 8 and its window 9. The contact pin 1 is clamped to the cable 4 in the manner described with reference to FIGS. 2, 3 and 6.

Figure 8:
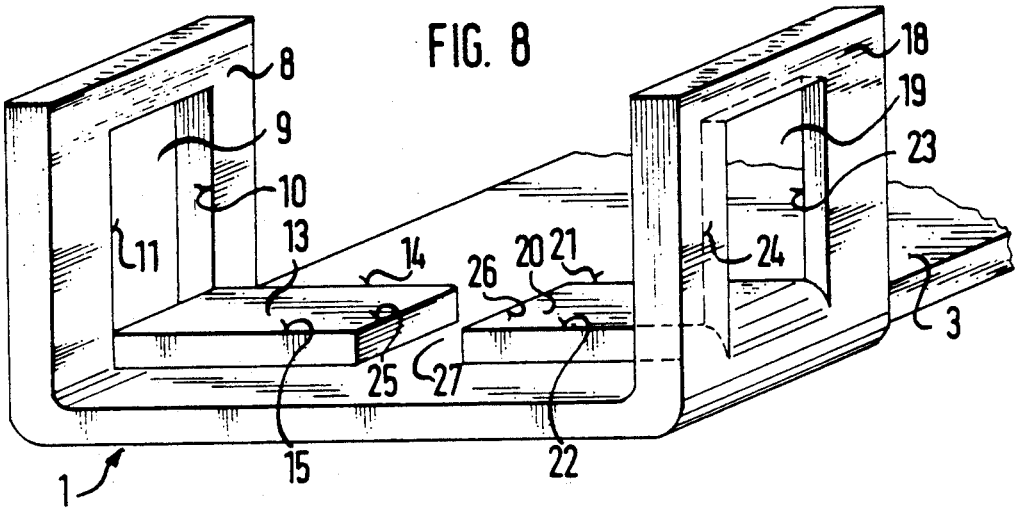
FIG. 8 is a fragmentary isometric view of yet a further embodiment of the invention.

The embodiment shown in FIG. 8 is essentially a doubled version of the embodiment shown in FIG. 7. A second lug 18 having a window 19 is provided with a further projection 20, located opposite to, and in alignment with, the lug 8. The projection 20 has two parallel upper cutting edges 21 and 22, the lug 18 having two inner cutting edges 23 and 24 mating with the edges 21 and 22. In this embodiment two cables, or two selected conductors of a multi-conductor cable, or of two cables thereof, can be clamped to the rear portion 3 in the manner described above.

According to a variant of the embodiment of FIG. 8, the clamping projections 13 and 20 may be provided with additional cutting edges 25 and 26 extending parallel to the longitudinal axis of the contact pin 1, there being a gap 27 between the projections 13 and 20. A cable can be laid on both of the projections 13 and 20 so that it projects partially into the gap 27. The edges 25 and 26 in addition to the inner ends of the cutting edges 14 and 15, and 21 and 22, then also penetrate the cable insulation and establish electrical contact with the cable conductor, as suggested by FIG. 13. The projections 13 and 20 may be provided only with the cutting edges 25 and 26.

Figure 9:
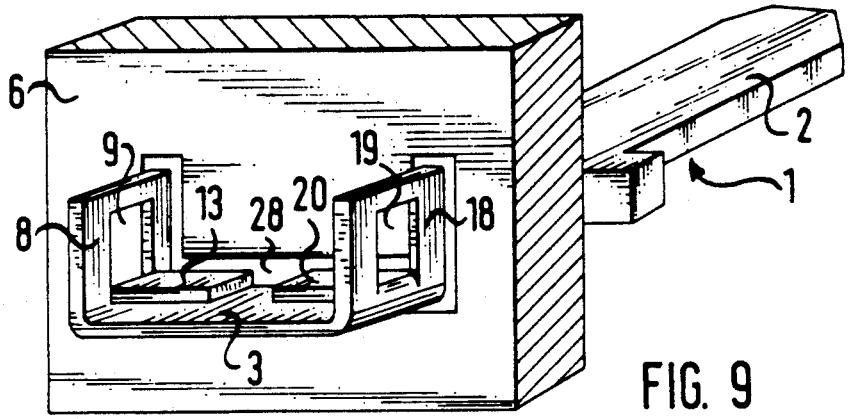
FIGS. 9, 10 and 11 are isometric views showing the embodiment according to FIG. 8 in conjunction with an insulating holder of the plug connector.
Figure 10:
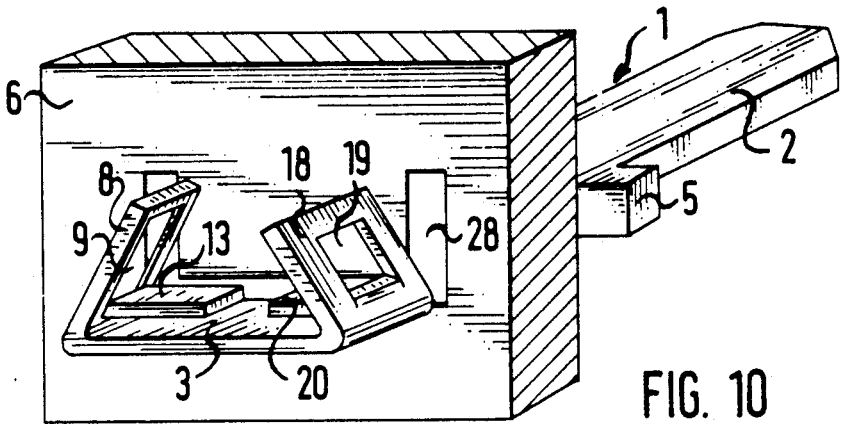

FIG. 9 shows a contact pin 1 in accordance with FIG. 8 after it has been pushed through a U-shaped passageway 28 in the insulating holder 6, only part of which is shown, the lugs 8 and 18 having been bent up accordingly. After such insertion of the contact pin 1, the lugs are further bent over as shown in FIG. 10 in order to prevent the pin 1 from dropping out of the holder 6. In this position of the lugs 8 and 18 on the contact pin or contact pins 1 fitted into the holder 6, the cable 4, or individual conductors of one or more multi-conductor cables, is, or are, clamped to the rear portion 3 of the pin 1, as described below with reference to FIG. 11.

Figure 11:
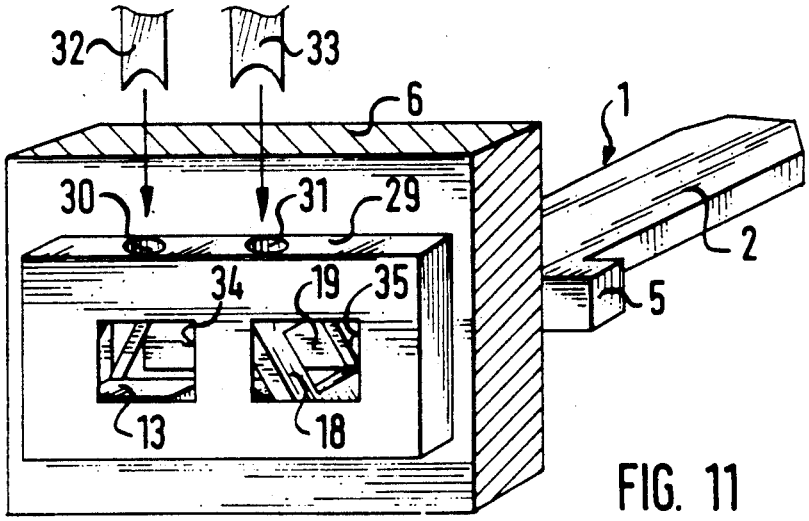

FIG. 11 shows the insulating holder 6 in combination with a hollow front part 29 which receives the lugs 8 and 18, and which has two preferably elliptical assembly holes 30 and 31 at its top, aligned with the lugs 8 and 18. The clamping punches 32 and 33 of a clamping tool (not shown) are engageable in said assembly holes 30 and 31. The hollow part 29 of the holder 6 has two front windows 34 and 35 through which the cable ends or conductor ends to be clamped are pushed so that their ends are correctly located on the corresponding projections 13 and 20. The punches 32 and 33 are then brought down, thereby pressing the lugs 8 and 18 down on to the said cable or conductor ends, and establishing electrical contact between the cable or conductors and the contact pin 1 by severing their insulation. A single larger window may be provided for each contact pin, rather than two windows.

Figure 12:
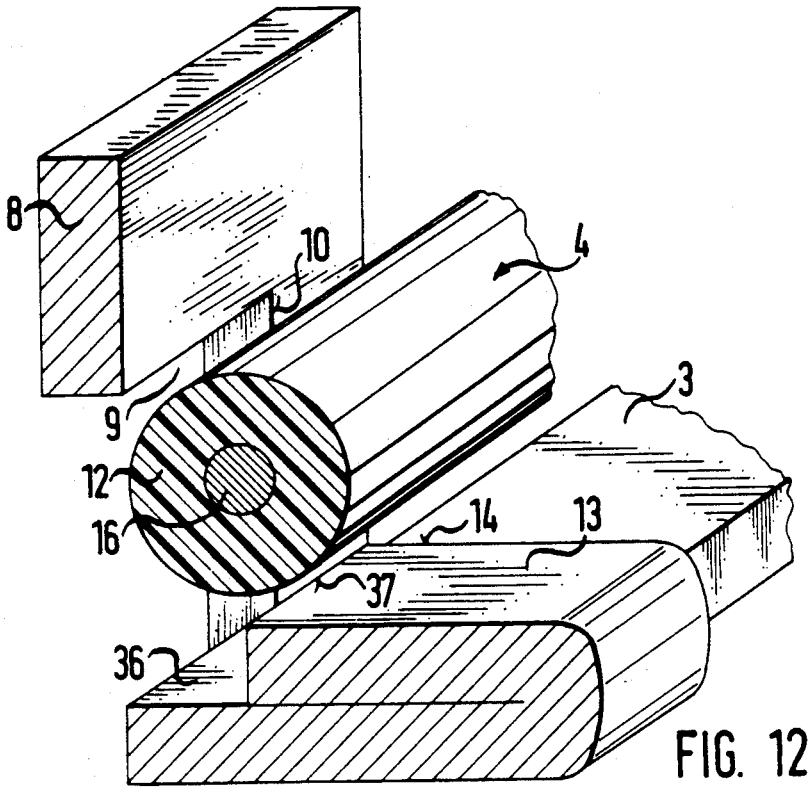
FIGS. 12 and 13 are isometric views shown partly in cross-section, of a further embodiment of the invention illustrating the insertion of a cable into the connector and the manner in which it is clamped thereto.
Figure 13:
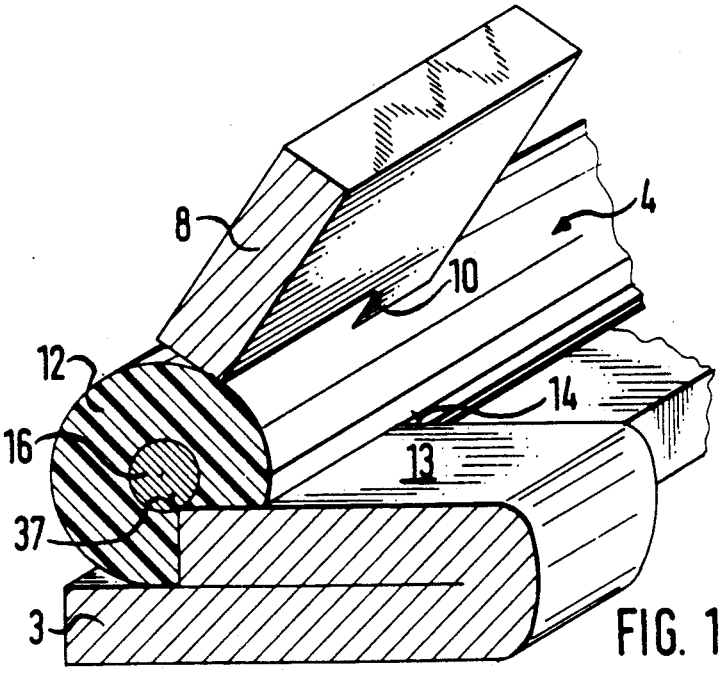

The embodiment of FIG. 12 is similar to those of FIGS. 1, 2 and 3, except that the projection 13 is formed by stamping out and bending a lateral arm of the portion 3. There is a gap between the vertical lug 8 with cutting edges 10 and 11 (only one of which is shown) and the inner end of the projection 13, thereby providing a clear space 36 into which the cable 4 can be partially inserted, as shown in FIG. 13. As well as its crosswise upper cutting edges 14 and 15 (only one of which is shown), the projection 13 also has a cutting edge 37, parallel with the longitudinal axis of the pin contact 1, which penetrates the insulation 12 of the cable 4 and thereby contacts the cable conductor 16, as will be apparent from FIG. 13. In the final clamped condition of the contact pin 1, the free end of he lug 8 is bent down in the manner indicated by the broken line in FIG. 2. In said clamped condition the cutting edges 9, 10, 14, 15 and 37 penetrate the cable insulation 12 and so make excellent electrical contact between the portion 3 and the conductor 16.

According to a modification of this embodiment the free space 36 can be eliminated and the projection 13 made to extend right up to the lug 8. The cable is then placed on the projection 13 so that the cutting edges 9, 10 and 14, 15 are brought to bear analogously with FIG. 3.

In the embodiments described above it has been assumed that all of the cutting edges are actively involved in the insulation severing process. Cases may, nevertheless, also arise in which it suffices for only one of the cutting edges of the lug or lugs, and one of the cutting edges of the projection or projections, to make electrical contact with the cable core. Cases may also occur where one or both cutting edges of the lug or lugs, or one or both cutting edges of the projection or projections, suffice(s) to make sufficient electrical contact. The same applies to all those cutting edges of the projection or projections which run parallel with said axis.

Figure 14:
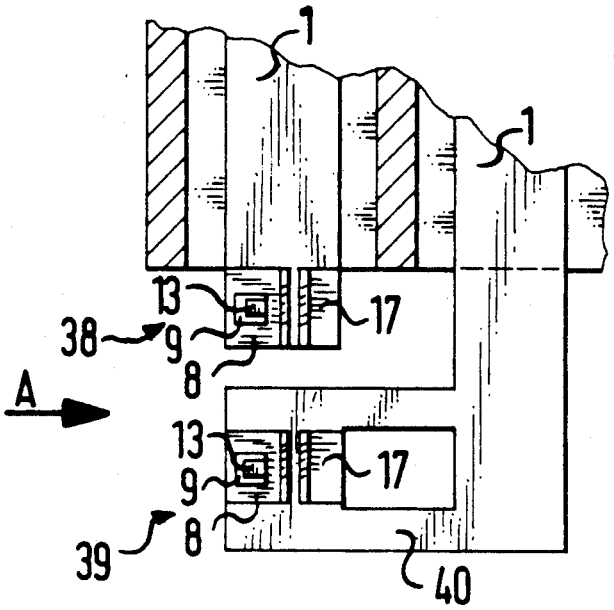
FIG. 14 is a fragmentary plan view of a further embodiment of the invention.
Figure 15:
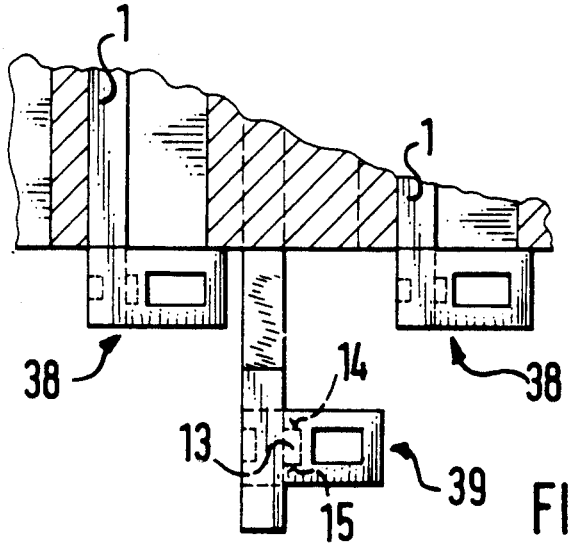
FIG. 15 is a view taken in the direction of the arrow A in FIG. 14.
Figure 16:
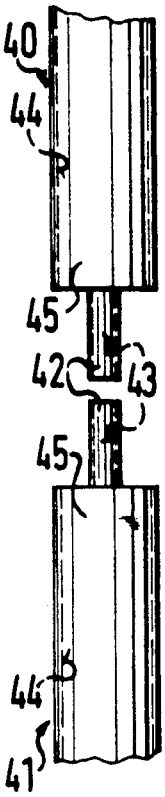
FIG. 16 is a plan view of a pair of screened cable end portions.

The embodiment shown in FIGS. 14 and 15 is for a screened electrical cable, an example of which is shown in FIG. 16. Clamping units 38 and 39, each consisting of at least one lug 8 and at least one projection 13, and of at least two adjacent contact pins 1, are, as seen in the longitudinal direction of these pins 1, arranged one behind the other, in spaced relationship. The shielding of the screened cable may be earthed by means of the clamping unit 39, the inner core of the screened cable being electrically connected to the clamping unit 38. The clamping units 38 and 39 should be in alignment in at least one plane, as shown in FIG. 14, so as to facilitate the clamping operations. To this end, one contact pin 1 has a lateral arm 40 on which the clamping unit 39 is provided. The clamping units 38 and 39 may also be provided with additional clamping flanges 17, that of the unit 39 being formed from the lateral arm 40 by stamping and bending. FIG. 15, which is a side view of FIG. 14 taken in the direction of the arrow A in FIG. 14 shows a lateral gap between the clamping units 38 and 39 at least one additional contact pin 1 with its clamping unit 38 being adjacent to the other two pins 1. This embodiment can be used with a screened cable having several inner conductors. If needed, a plurality of further contact pins 1 each having a lateral clamping unit 39 can be provided. Said further contact pins 1 having lateral clamping units 39 may be so arranged that each individual unit 39 is exactly aligned with the associated clamping unit 38 of a contact pin 2, for example by bending at right angles, or otherwise suitably angling, the lateral arm 40. The units 38 and 39 shown in FIG. 15 would then also be aligned with one another.

Figure 17:
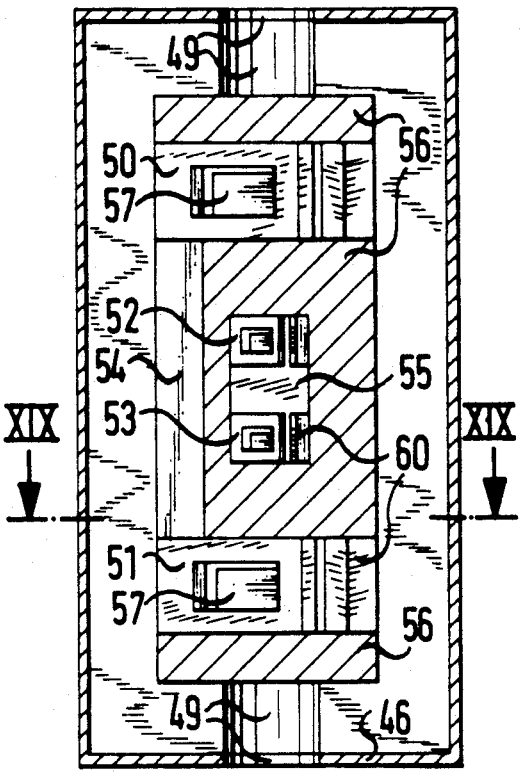
FIG. 17 is a plan view shown partly in section of a further embodiment of the invention.
Figure 18:
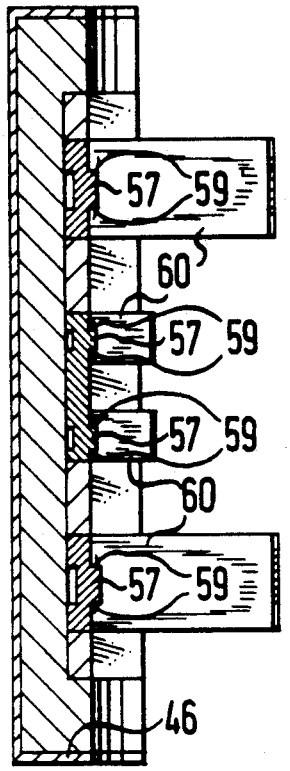
FIG. 18 is a longitudinal sectional view of the embodiment of FIG. 17.
Figure 19:
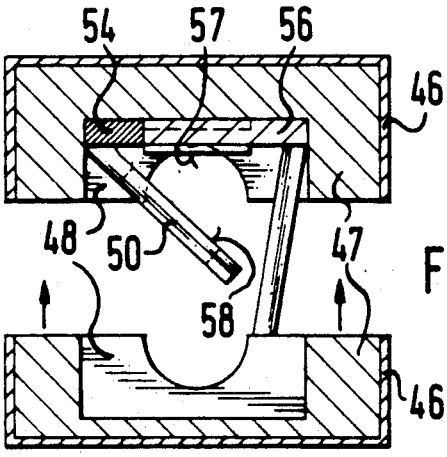
FIG. 19 is a cross-sectional view of the embodiment of FIG. 17.

In the embodiment of FIGS. 17 to 19 an electrical connector comprises electrical contacts for coupling screened cables 40 and 41, for example as shown in FIG. 16. Each of these cables comprises an inner conductor 43 surrounded by inner insulation 42, and shielding 44 surrounded by outer insulation 45, the end portion of shielding 44 and insulation 45 having been stripped from the insulated inner conductor 43.

An extended metal housing 46 contains an insulating insert 47 defining a central hollow chamber 48, in which are provided electrical contacts for connecting the ends of the cables 40 and 41, as shown in FIGS. 17, 18 and 19. The housing 46 and the insert 47 have axial passageways 49 opening into their ends for the insertion of the cable ends.

Said electrical contacts for coupling two screened cables each consist of at least two pairs of clamping arms 50, 51 and 52, 53, respectively. The respective clamping arms 50 and 51, and 52 and 53 are spaced axially apart from one another, and are interconnected by means of longitudinal webs 54 and 55, respectively. The arms 52 and 53 are inner clamping arms, the arms 50 and 51 being outer clamping arms. All of said clamping arms extend at right angles to the webs 54 and 55, for clasping the cables at appropriate points. The said electrical contacts are fixedly mounted in the chamber 48, in which they are insulated from one another by means of additional insulating components 56. The said contacts may be alternatively fixed in corresponding recesses in the insulating insert 47.

As best seen in FIGS. 17 and 18, the inner clamping arms 52 and 53 which are for the electrical connection of the inner cable conductors 43 are arranged between, and in alignment with, the clamping arms 50 and 51 which are for the electrical connection of the two cable shields 44, the axis of said alignment essentially corresponding to the longitudinal axis of the cables 40 and 41 which are to be connected. The clamping arms 50 to 53 are, as shown in FIG. 17 in the form of lugs each of which mates with a stamped out clamping projection 57 so as to cut through the insulation of the corresponding cable for establishing electrical contact. Each clamping lug 50 to 53 is formed with a cutting edge on its inner perimeter, that is to say, on its side facing the clamping projection 57, as indicated at 58 in FIG. 19. The projections 57 may, be provided with opposed cutting edges 59 (FIG. 18). The remaining construction and operation of these electrical contacts are as in the embodiments described above. In this embodiment also, additional clamping arms 60 may be provided, which overlie the lugs 50 to 53 in the clamped condition of said contacts in order to reinforce their clamping effect.

In the embodiment of FIGS. 17 to 19 as described above, only a single inner pair of inner clamping arms is provided, consisting of the clamping arms 52 and 53. Where, however, screened cables each have a plurality of inner conductors, a correspondingly greater number of pairs of inner arms are provided.

The cable ends prepared as shown in FIG. 16 are inserted into the inner part of the housing containing the clamping arms 50 to 53 so that the inner cable conductors 43 locate beneath the inner clamping arms 52 and 53 and the unstripped cable end portions locate beneath the outer clamping arms 50 and 51. All of the clamping arms or lugs are then pressed on to the cables so that the insulation 42 and 45 is cut through by the cutting edges 58 and 59 whereby electrical contact is made between the inner conductors 42, and between the shielding 44 at the ends of the cables 40 and 41. The additional clamping arms 60 are then pressed on to the clamping arms 50 to 53 and the outer part of the housing is connected to the inner part thereof, for example by means of screws.

WHAT IS CLAIMED IS

1. An electrical connector comprising an insulating holder and at least one elongate electrical contact pin for insertion thereinto, said contact pin having a rear portion from which projects a first clamping part in the form of a clamping member having an initial position in which the clamping member projects normally of said contact pin for bending over into a clamping position against an insulated cable to penetrate the insulation thereof to make electrical contact with a conductor of the cable; wherein the clamping member is in the form of an apertured lug having an inner perimeter, said rear portion of the contact pin having at least one second clamping part in the form of a projection located so as to be at least partially surrounded by said lug in said clamping position thereof, said projection having an upper perimeter, said clamping parts having at least one perimetral insulation cutting edge and said lug having an intermediate bent position for locking said contact pin in the holder when said contact pin has been inserted thereinto.

2. A connector as claimed in claim 1, wherein said at least one cutting edge is provided on said inner perimeter, of said lug.

3. A connector as claimed in claim 1, wherein said at least one cutting edge is provided on said upper perimeter of said projection.

4. A connector as claimed in claim 1, wherein said at least one cutting edge is provided on both of said inner and said upper perimeters.

5. A connector as claimed in claim 1, wherein said at least one projection is in the form of a stamping from the rear portion of said contact pin.

6. A connector as claimed in claim 1, wherein said at least one projection is in the form of a bent over crosspiece of the rear portion of said contact pin.

7. A connector as claimed in claim 1, wherein said at least one lug is in the form of a stamping from a blank of the rear portion of said contact pin, said at least one projection being in the form of a substantially rectangular tab- partially stamped out from said blank, being integrally joined thereto at an edge of said tab and lying on the rear end portion of said contact pin.

8. A connector as claimed in claim 1, wherein said at least one lug has a free end portion shaped for clasping an edge of said rear portion opposite to said lug in the clamping position thereof.

9. A connector as claimed in claim 1, wherein said rear portion is integrally connected to a clamping flange for clasping said lug in the clamped position thereof.

10. A connector as claimed in claim 1, wherein said projection consists of a bent over crosspiece on said rear portion disposed opposite to said lug, a cutting edge provided on a free end of said crosspiece opposite to said lug extending lengthwise of said contact pin, said free end being spaced from said lug to provide a recess, for partially receiving said cable.

11. A connector as claimed in claim 1, wherein two said projections facing each other at right angles to the length of said contact pin define a gap therebetween, a respective one of said lugs being associated with each projection and surrounding it in the clamped position of that lug.

12. A connector as claimed in claim 11, wherein each projection has an upper edge extending lengthwise of the contact pin to provide said at least one cutting edge.

13. A connector as claimed in claim 1, for use with a screened cable, comprising a plurality of clamping units each consisting of a plurality of adjacent ones of said contact pins arranged one behind the other in spaced relationship lengthwise of the contact pins.

14. A connector as claimed in claim 13, wherein said clamping units are aligned with each other in at least one plane.

15. An electrical connector for coupling at least two insulated, shielded electrical cables, the connector comprising; electrical contact elements for connecting together at least one inner conductor and the shielding of the cables; and an insulating holder for the contact elements and for ends of the cables; wherein said contact elements comprise at least two pairs of clamps for said inner conductors and said shielding, respectively, each clamp having clamping arms in the form of apertured clamping lugs which are spaced from each other, and longitudinal webs interconnecting said contact arms and extending at right angles thereto, the clamping arms of the clamps for said inner conductors being arranged between the clamping arms of the clamps for said shielding, each lug having an initial position and a clamping position, a projection of each contact element being positioned opposite to the lug thereof so as to be surrounded thereby when the lug is in its clamping position, the opposed lug and projection of each contact element having at least one perimetral cutting edge for severing the insulation of a respective cable.

16. A connector as claimed in claim 15, wherein said at least one cutting edge is provided on an inner perimeter of said lug.

17. A connector as claimed in claim 15, wherein said at least one cutting edge is provided on an upper perimeter of said projection.

18. A connector as claimed in claim 15, wherein said at least one cutting edge is provided on an inner perimeter of said lug and on an upper perimeter of said projection.

* * * * *